US005997217A

United States Patent [19]

Verret

[11] Patent Number: 5,997,217

[45] Date of Patent: Dec. 7, 1999

[54] SHALLOW WATER WELL-DRILLING APPARATUS

[76] Inventor: Rodney J. Verret, Grand Bois Rd., Breaux Bridge, La. 70517

[21] Appl. No.: 09/075,175

[22] Filed: May 11, 1998

[51] Int. Cl.[6] ..... E02B 17/08

[52] U.S. Cl. ..... 405/196; 405/195.1; 405/201; 405/203; 405/209; 114/265

[58] Field of Search ..... 405/196, 199, 405/200, 201, 202, 203, 204, 205, 206, 207, 209; 114/258, 265; 175/5, 6, 7, 8, 9

[56] References Cited

U.S. PATENT DOCUMENTS

| | | | |
|---|---|---|---|
| 2,551,375 | 5/1951 | Hayward | 405/207 |
| 2,889,795 | 6/1959 | Parks | 114/265 X |
| 3,078,680 | 2/1963 | Websala | 405/209 |
| 4,103,503 | 8/1978 | Smith | 405/196 |
| 4,436,050 | 3/1984 | Liden | 114/265 |
| 4,565,150 | 1/1986 | Liden | 114/265 |
| 4,602,894 | 7/1986 | Lorenz et al. | 405/203 |
| 4,938,628 | 7/1990 | Ingle | 405/203 X |
| 4,973,200 | 11/1990 | Kaldenbach | 405/203 X |
| 5,102,264 | 4/1992 | Thomas et al. | 405/203 X |
| 5,183,376 | 2/1993 | Aralt | 405/209 X |
| 5,388,930 | 2/1995 | MeNease | 405/203 X |
| 5,403,124 | 4/1995 | Kocaman et al. | 405/209 |
| 5,419,657 | 5/1995 | Davis | 405/209 |
| 5,829,919 | 11/1998 | Heerema | 405/209 |

OTHER PUBLICATIONS

*The Macmillan Visual Dictionary* (1995), pp. 738–739.

Advertising Folder Back Cover, UNIFAB Incorporated, New Iberia, Louisiana (no date).

*Primary Examiner*—David Bagnell
*Assistant Examiner*—Jong-Suk Lee
*Attorney, Agent, or Firm*—Thelen Reid & Priest

[57] ABSTRACT

A submergible vessel for use in shallow-water oil drilling includes a pair of spaced pontoons selectively submergible and raisable in water by the admission and expulsion of water, a main deck, a frame supporting the main deck over the pontoons, and a jacking system for horizontally and vertically translating a packaged drilling rig positioned thereon. The jacking system includes a pair of parallel cantilever beams positioned on the main deck adjacent the stern, vertical jacks for selectively translating the cantilever beams in a vertical direction above the main deck, and horizontal jacks for selectively translating the cantilever beams in a horizontal direction along their longitudinal axes. The deck has an inwardly extending slot formed therein at the stem, and the cantilever beams are positioned on either side of the slot, with their longitudinal axes parallel to the longitudinal axis of the deck. The cantilever beams are spaced apart to support the packaged drilling rig, the jacking system being operable to move the packaged drilling rig either outward over the slot or outward and upward to the edge of the deck of a fixed drilling platform. The cantilever beams are retained on guide shoes, each of which includes rollers which can be raised to permit horizontal movement of the cantilever beams relative to the guide shoes. In use, the vessel can be towed out to a well site and the pontoons are submerged stem first so as to rest on the sea floor. The jacking system can then be used to move packaged drilling rig to the drilling platform deck.

12 Claims, 10 Drawing Sheets

SHALLOW WATER WELL-DRILLING APPARATUS

BACKGROUND OF THE INVENTION

1. Field of the Invention

The present invention relates to apparatus and a method for the drilling and re-entry of oil and gas wells in shallow, offshore waters. More specifically, the invention relates to a bottom-setting vessel incorporating a jacking system and a method of using such a vessel and jacking system for transporting and positioning packaged drilling rigs and production facilities.

2. Related Art

Oil and gas wells in shallow offshore waters (that is, water between about 10 feet and 150 feet deep) were initially drilled by means of platform drilling rigs, jack-up rigs, or submersible rigs. In all cases, the wells were outfitted employing a well for operational or safety purposes. Single-caisson, well-protect structures or platforms were employed in the drilling and production operations.

Presently, the re-entry and drilling of offshore prospects are in demand. Early production platforms or "first oil" systems are being employed to eliminate the need to drill new wells, and thus to reduce the time for sales of oil. Because the platforms no longer have drilling rigs, packaged drilling rigs must be brought out to the platforms in order to achieve the desired re-entry. Jacking systems may be used to jack the platform out of the water by using the ocean bottom as the jack base.

SUMMARY OF THE INVENTION

It is a primary object of the present invention to provide apparatus and a method for efficiently re-entering, drilling, and providing early production facilities.

It is another object of the present invention to provide a jacking system for drilling floor substructures which is supported by a bottom-setting vessel.

It is still another object of the present invention to provide a jacking system for drilling floor substructures which allows for both drilling and production operations.

These and other objects are achieved by the provision of a submergible vessel for use in shallow-water oil drilling, which includes a pair of spaced pontoons selectively submergible and raisable in water by the admission and expulsion of water, a main deck, a frame supporting the main deck over the pair of pontoons, and a jacking system including a pair of parallel cantilever beams positioned on the main deck adjacent the stem, means for selectively translating the cantilever beams in a vertical direction above the main deck, and means for selectively translating the cantilever beams in a horizontal direction along their longitudinal axes. The cantilever beams are spaced apart to support a packaged drilling rig, the vertical and horizontal translating means being operable to move the packaged drilling rig outward and upward to the edge of the deck of a fixed drilling platform.

In one aspect of the invention, the deck has an inwardly extending slot formed therein at the stern, and the cantilever beams are positioned on either side of the slot, with their longitudinal axes parallel to the longitudinal axis of the deck..

In another aspect of the invention, the means for selectively translating the cantilever beams in a vertical direction above the main deck includes two vertical jack legs positioned proximate each end of each of the cantilever beams, and a drive system drivingly associated with each of the vertical jack legs for raising and lowering the vertical jack legs. This drive system can comprise a rack mounted to each of the jack legs, at least one pinion selectively engageable with the rack, and a drive motor drivingly connected to the pinion. Preferably, a lock also is provided, which is selectively engageable with the rack.

Each cantilever beam is mounted to its respective jack legs by a guide shoe, the guide shoes being pivotably mounted to the jack legs. Each shoe includes a platform, a pair of Hillman rollers housed in the platform, and a shoe jack shoe jack for selectively raising and lowering the Hillman rollers above the surface of the platform, whereby the cantilever beam can be raised off of and lowered onto the platform.

In still another aspect of the invention, the means for selectively translating the cantilever beams in a horizontal direction comprises a reciprocable piston rod fastened to one end of each of the cantilever beams, and means for fixing the piston relative to the while the piston rod is extended and retracted.

In the event that the deck of the fixed drilling platform is too low for alignment with the cantilever beams, a pony structure can be provided on the vessel which is movable onto the deck of the fixed drilling platform by a crane mounted on the vessel deck. The pony structure includes a frame and a pair of spaced, horizontally-extending, parallel beams positioned on the frame, on which a packaged drilling rig can be placed.

In use, the vessel is towed out to the well site and the pontoons are submerged stem first so as to rest on the sea floor. The cantilever beams with the packaged drilling rig resting thereon are extended to the edge of the drilling platform deck, and then raised to the level of the drilling platform deck. Conventional gripper jacks can then be used to skid the packaged drilling rig off of the cantilever beams onto the cap beams of the drilling platform deck.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
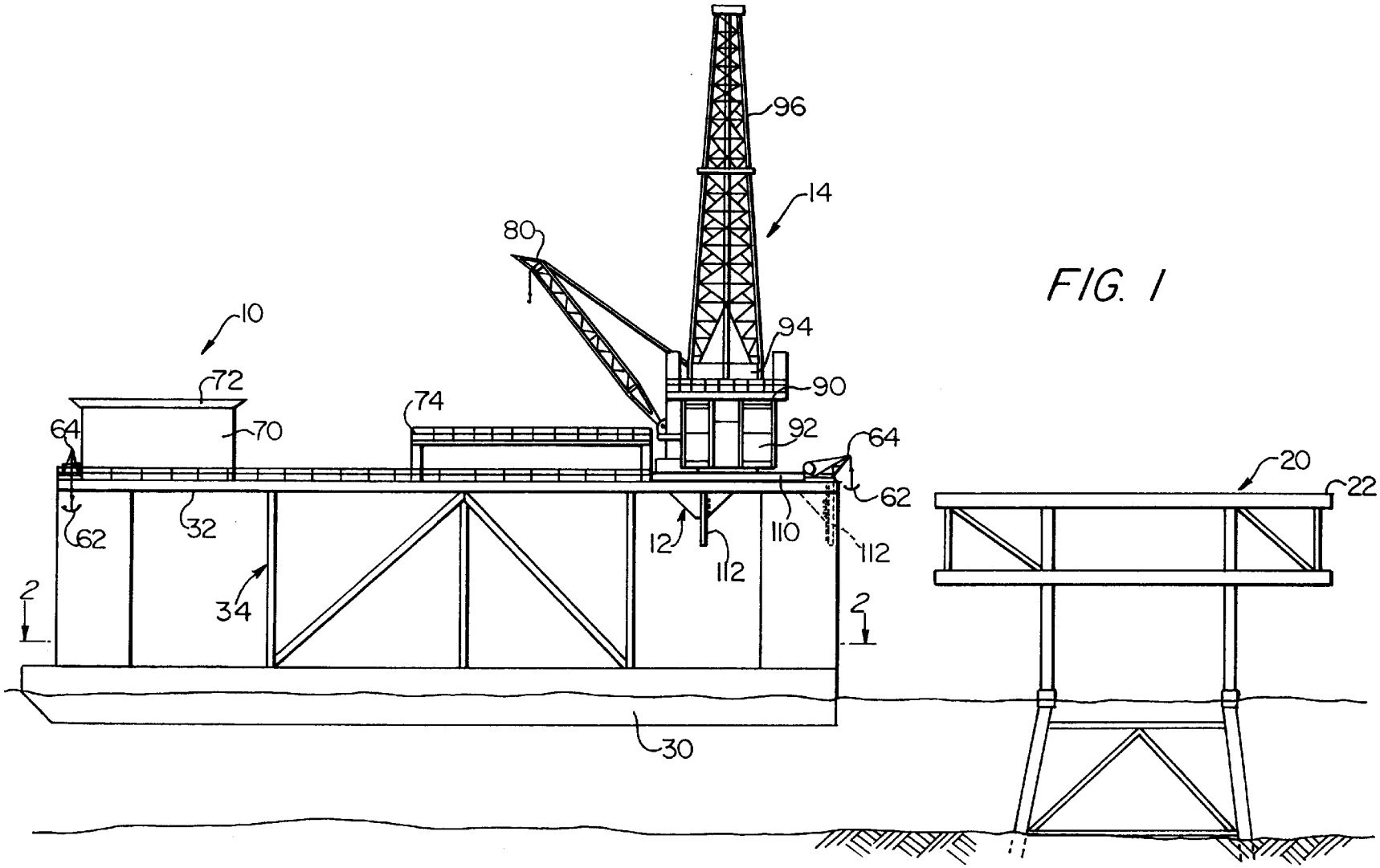
FIG. 1 is a port side elevational view of a bottom-setting vessel incorporating a vertical jacking system, in accordance with the present invention, approaching a fixed oil drilling platform

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
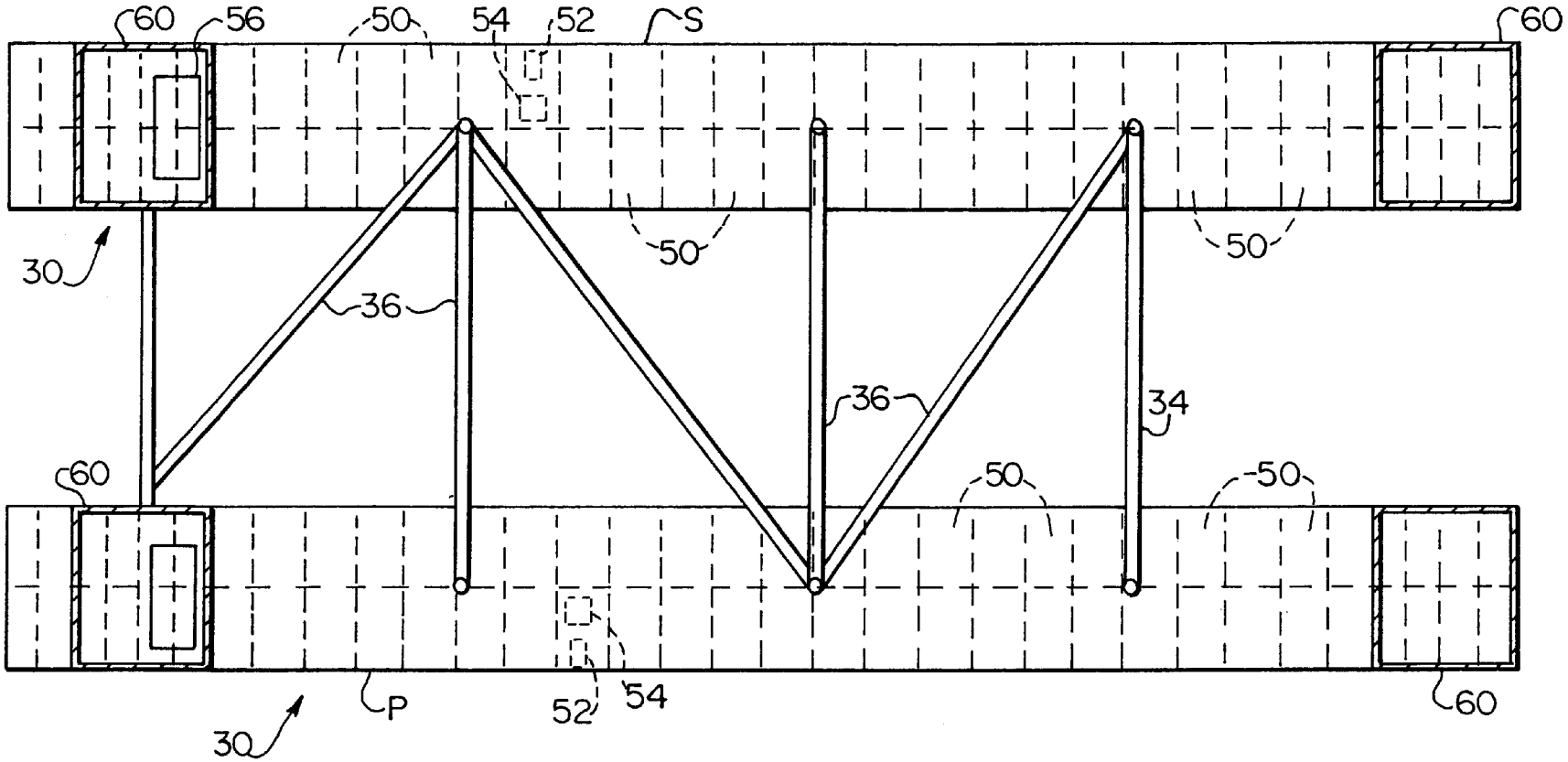
FIG. 2 is a cross-sectional view taken along line 2—2 of FIG. 1.
Figure 3:
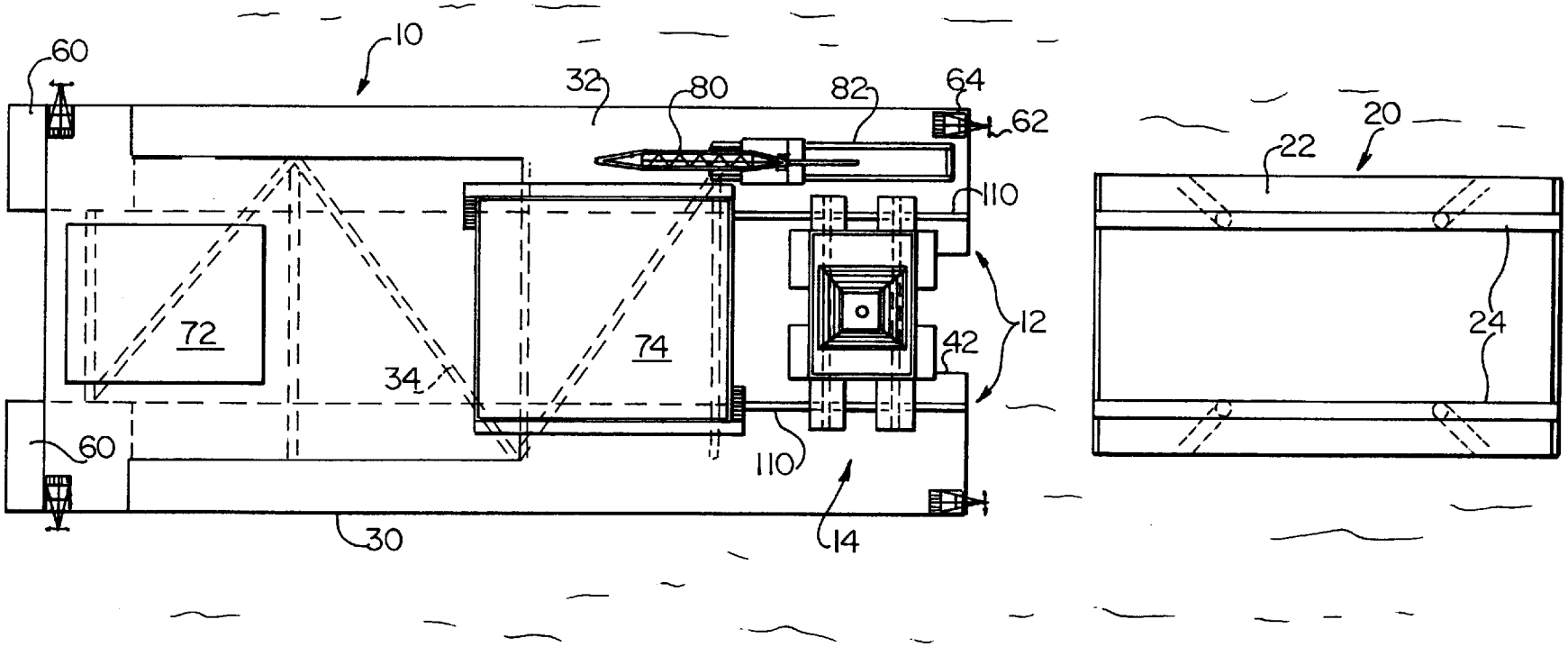
FIG. 3 is a plan view of the vessel and the fixed drilling platform of FIG. 1

Referring now to FIGS. 1–3, there is shown a vessel 10 in accordance with the present invention, which has a part side P and a starboard side S and incorporates a jacking system 12 also in accordance with the present invention, for positioning the packaged drilling rig 14 of a drilling package either relative to an underwater well-head (not shown) or for transferring the packaged drilling rig 14 to a conventional fixed oil drilling platform 20. Such a drilling platform 20 conventionally has a drilling deck 22 provided with a pair of parallel skid or cap beams 24 spaced 40 feet or 45 feet apart. The vessel 10 is designed to be towed, ballasted down, and operated in a water depth of up to 45 feet (13.7 meters).

The vessel 10 includes a pair of spaced, submersible lower hulls or pontoons 30 (best seen in FIG. 2) and a main deck 32 supported over the pair of lower hulls 30 by a main structural frame 34 comprising a system of trusses. These trusses preferably are formed of tubular struts capable of withstanding the sea action and loading conditions to which the vessel 10 is subjected as a result of wave and current actions. The main structural frame 34 also includes a pair of spaced, parallel main structural beams 40 located just below the deck 32. A rectangular slot 42 is formed in the deck 32 extending inwardly from the stern of the vessel, between the main structural beams 40. As shown in FIG. 2, the lower hulls 30 are also joined to each other by a system of trusses formed of tubular struts 36.

Water can be pumped into the lower hulls 30 to function as ballast, in order to submerge the lower hulls 30 and set them on the ocean floor. Each of the lower hulls 30 is divided into a plurality of compartments 50, preferably four; and each of the compartments 50 has its own conventional pump 52 and conventional jetting system 54 for respectively pumping ballast water in and expelling water from the compartments 50, to submerge the lower hulls 30 or raise them off the ocean floor. A pump room 56 is provided in each of the lower hulls 30, for controlling the pumps 52. The jetting systems 54 are connected to the rig pumps (not shown) or to a stand-by system (also not shown).

Stabilization columns 60 extend between the main deck 32 and the lower hulls 30, and are provided at each end of both of the lower hulls 30 for use during the ballasting operation, as described in greater detail hereinafter. Stabilization columns 60 can also be provided between the ends of the lower hulls 30. A four point anchoring system is also provided, the anchoring system comprising one anchor 62 and winch 64 provided at each corner of the vessel 10.

As shown in FIGS. 1 and 3–8, the main deck 32 can include crew quarters 70 (which preferably is located at the bow), a heliport 72 (which can be positioned above the crew quarters), a pipe rack deck 74 located aft of the slot 42, and a pivotable crane 80 movable on a rail 82 mounted on the deck 32 to one side of the forward end of the pipe rack deck 74.

The rectangular slot 42 formed in the main deck 32 is adapted for placement over a conventional underwater well center (not shown). The jacking system 12 in accordance with the present invention is provided on either side of the slot 42 in conjunction with the main structural beams 40, as will be described in greater detail hereinafter.

Figures 18, 19:
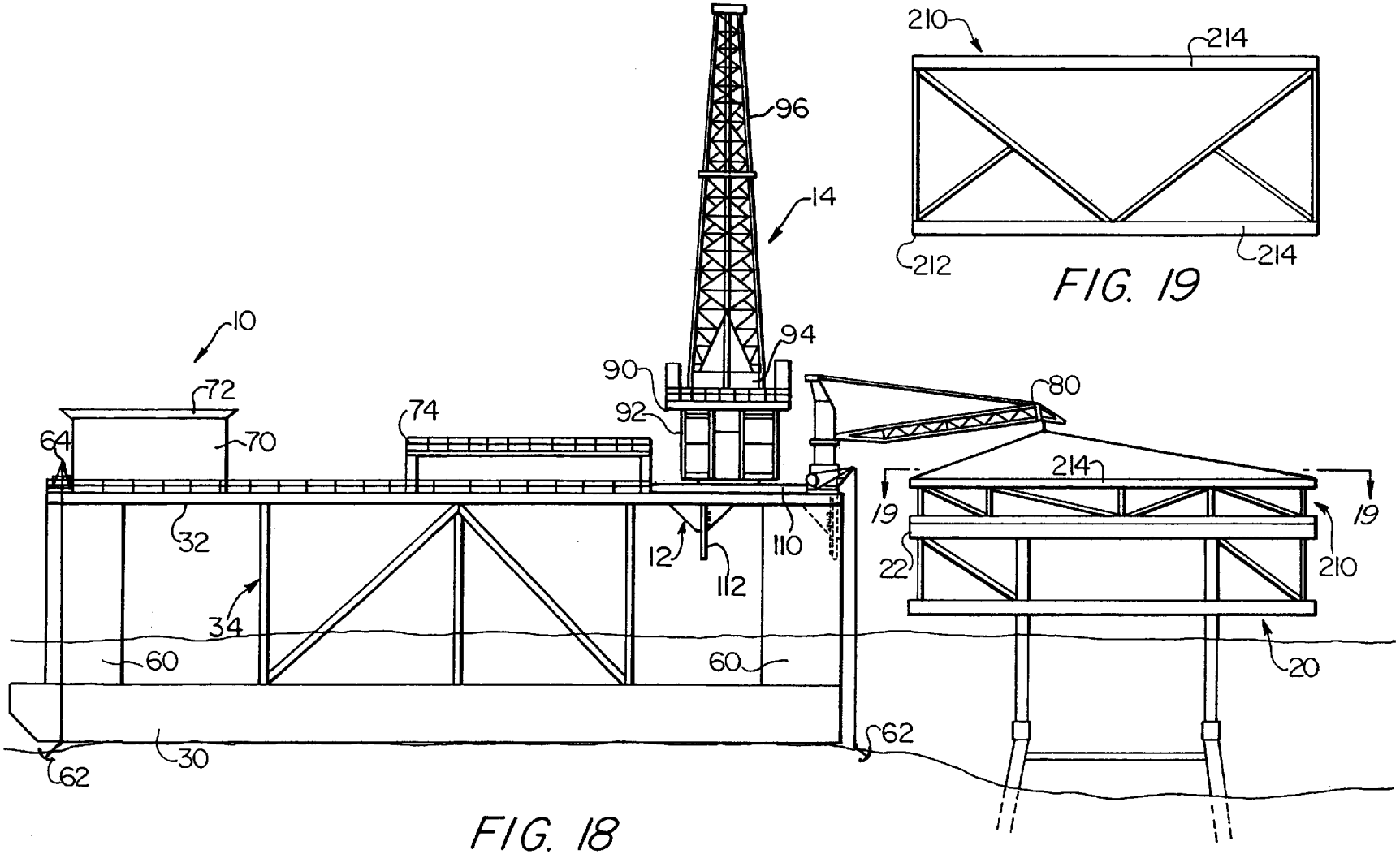
FIG. 18 is a port side elevational view of a vessel in accordance with the present invention submerged next to a fixed drilling platform, with a pony structure further in accordance with the present invention placed on the fixed drilling platform.
FIG. 19 is a cross-sectional view taken along line 19—19 of FIG. 18, showing the pony structure.

An example of a packaged drilling rig 14 of the type with which the present invention is intended to be used is best shown in FIGS. 1, 3, and 18. The packaged drilling rig 14 includes a drill floor 90, a substructure 92 beneath the drill floor 90, and drilling equipment 94 and a derrick 96 supported by the substructure 92 and the drill floor 90. The packaged drilling rig 14 is designed to allow the crane 80 to load or off-load it onto the vessel 10. It will fit onto 40 foot or 45 foot skid beams 24 (that is, skid beams spaced 40 or 45 feet apart) on the drilling platform 20. For purposes of the present invention, the packaged drilling rig 14 rests on a pair of spaced spanner beams 100, which in turn rest on the jacking system 12 transverse to the main structural beams 40. During towing of the vessel 10, the packaged drilling rig 14 is retracted over the slot 42.

The purpose of the jacking system 12 is to translate the packaged drilling rig 14 vertically and horizontally as necessary to accommodate the design and placement of the well with which they are being used. The jacking system 12 is shown in greater detail in FIGS. 11–15. The jacking system 12 includes port and starboard cantilever beams 110 which are positioned on either side of the slot 42 over the main structural beams 40 of the vessel 10.

The cantilever beams 110 are generally I-shaped in cross-section, having upper and lower horizontal flanges **110*a* and 110*b* and a vertical web 110*c* joining the upper and lower flanges 110***a* and 110*b*. In the vessel's drilling mode, the cantilever beams 110 can be used to support a packaged drilling rig 14 or a production package (not shown) over the slot 42.

Each cantilever beam 110 is movable vertically by two vertical jack units 112 and horizontally by a single horizontal jack unit 114. The vertical jack units 112 each comprise a jack housing 120 mounted to the main structural frame 34 of the vessel 10 proximate each end of the cantilever beam 110, and a jack leg 122 (which is preferably of tubular construction) housed in the jack housing 120. Further, each vertical jack unit 112 is equipped with a drive system, for example a rack 124 mounted to and extending the length of the jack leg 122, a drive motor 130 (preferably, a hydraulic motor) mounted in the jack housing 120, pinions 132 mounted on and drivingly connected to the drive motor 130 for engagement with the rack 124, and a hydraulically-operated lock 134 mounted in the jack housing 120 above the motor, for locking engagement with the rack 124. The hydraulically-operated lock 134 includes teeth 140 configured for mating engagement with the teeth of the rack 124, and a hydraulically-operated cylinder 142 for selectively moving the lock 134 into and out of engagement with the rack 124.

Each cantilever beam 110 is mounted to its corresponding jack legs 122 by means of two guide shoes 150 (FIGS. 13–15), each of which is pivotably attached to the upper end of each jack leg 122 by means of a pivot pin 152. Each guide shoe 150 comprises a guide shoe platform 154 on which the lower flange 110*b* of the cantilever beam 110 rests, and spaced pairs of flanged members 160 on either side of the guide shoe platform 154 which engage the sides of the lower flange 110*b* and prevent transverse movement of the cantilever beam 110 relative to the guide shoe platform 154. The guide shoe platform 154 houses forward and rearward sets of conventional Hillman rollers 162, which extend through the guide shoe platform 154, and forward and rearward, hydraulically-actuated shoe jacks 164 located under the forward and rearward sets of Hillman rollers 162, respectively. The shoe jacks 164 selectively raise and lower the Hillman rollers 162, thereby raising the cantilever beam 110 off the guide shoe platform 154 or lowering it onto the guide shoe platform 154. Both the cantilever beam 110 and the guide shoe platform 154 preferably are made of a metal. The flanged members 160 are so dimensioned that the lower flange 110*b* of the cantilever beam 110 has sufficient room to move vertically off the guide shoe platform 154 and roll horizontally along its longitudinal axis, on the Hillman rollers 162. When the cantilever beam 110 rests directly on the guide shoe platform 154, the metal-to-metal contact, in combination with the weight of the cantilever beam 110 (and when present, the packaged drilling rig 14) prevents the cantilever beam 110 from moving on the guide shoe platform 154. The pivot pin 152 enables the guide shoes 150 at both ends of the cantilever beam 110 to align with each other even if their respective jack legs 122 are not at precisely the same height.

The jack legs 122 extend through channels 170 in the main structural beams 40 of the vessel, and apertures 172 are provided in the main structural beams 40 at the top of the channels 170 for the guide shoes 150, thereby allowing the cantilever beams 110 to rest on the main structural beams 40 of the vessel when the jack legs 122 are fully retracted.

Figure 16:
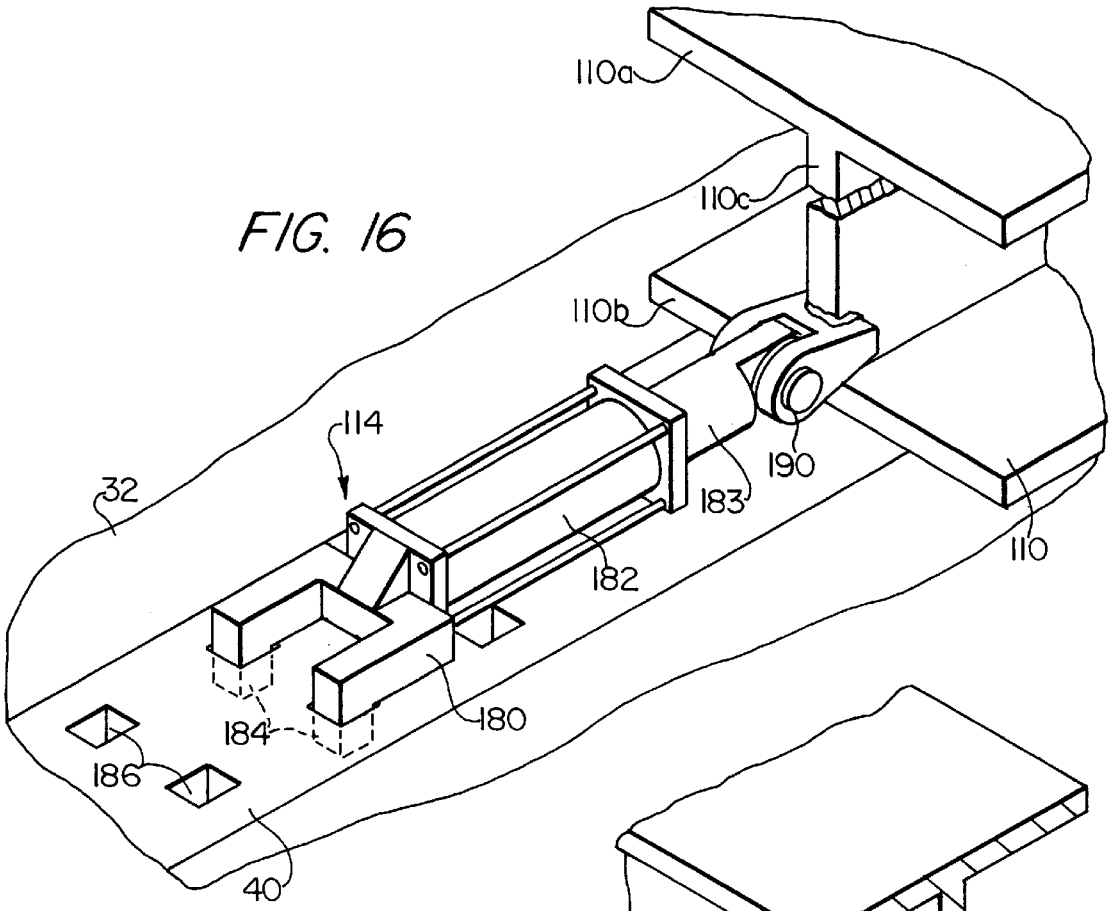
FIG. 16 is a perspective view of a horizontal jack unit of the jacking system in accordance with present invention.
Figure 17:
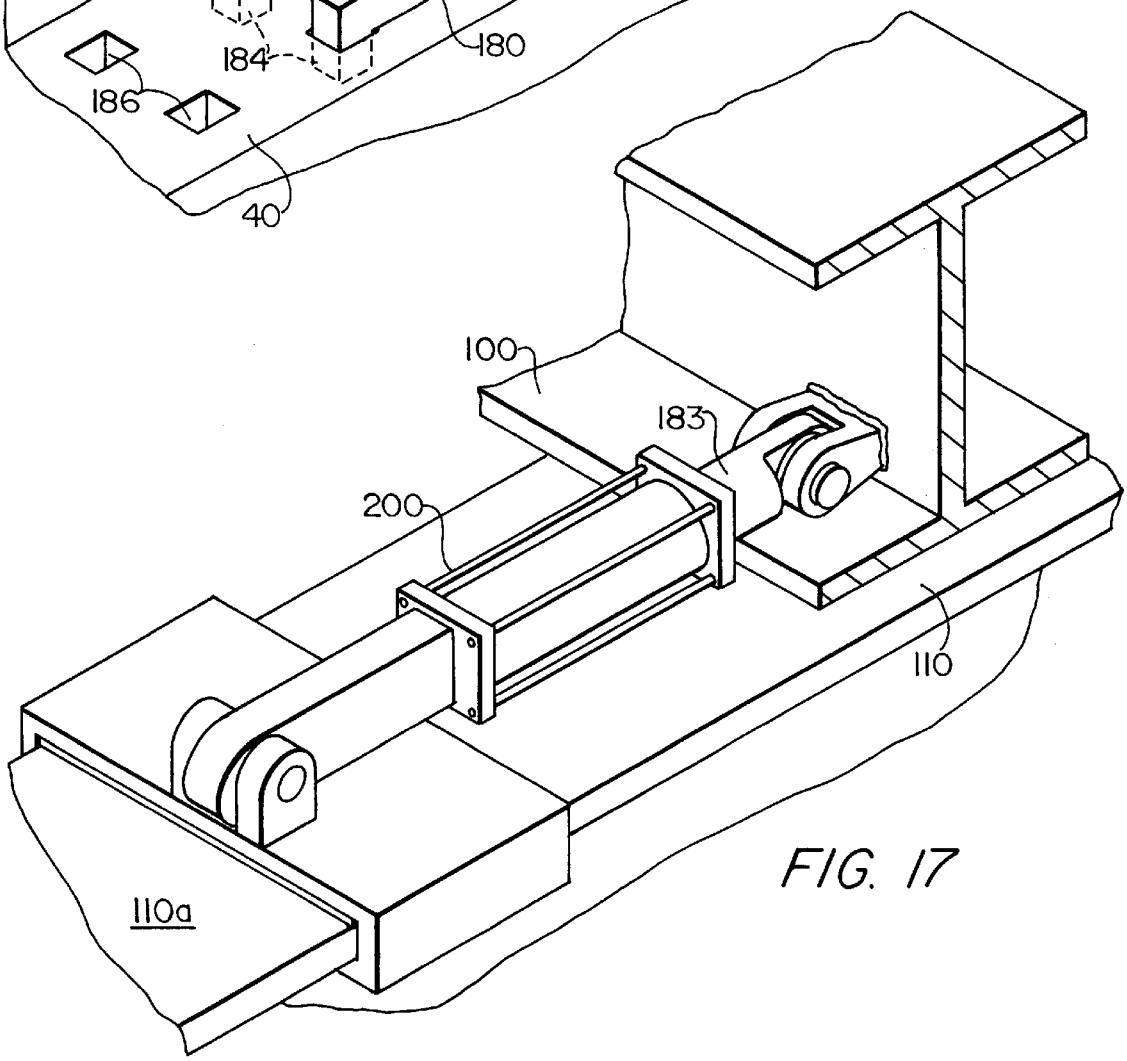
FIG. 17 is a perspective view of a gripper jack connected to a cantilever beam in accordance with the present invention.

Each cantilever beam 110 also is movable horizontally along its longitudinal axis by a horizontal jack unit 114 positionable on the main structural beam 40 adjacent the forward end of the cantilever beam 110. As best shown in FIGS. 16 and 17, each horizontal jack unit 114 comprises a sliding jack including a base 180 and a hydraulically-operated conventional cylinder and piston assembly 182 including a reciprocable piston rod 183 with assembly 182 being attached to the base 180. The base 180 includes means, such as a pair of pins 184 insertable into pairs of aligned apertures 186 in the main structural beam 40 on which the cantilever beam 110 rests, which enables the base 180 to remain fixed relative to the frame 34 while the piston rod is extended or retracted. The piston rod can be fastened to the forward end of the cantilever beam 110 by fastening means, such as a yoke and pin assembly 190. The pistons 182 of the sliding jacks can be moved forward and backward by a hydraulic power system (not shown) to move the cantilever beams 110 forward and backward. When the vessel 10 is in the drilling mode, the cantilever beams 110 can be used to move the rotary (not shown) of the packaged drilling rig 14 outward as far as 15 feet (4.6 meters). The horizontal jacking units 114 can move the packaged drilling rig 14 to accommodate 6-12-24 wells.

Figure 4:
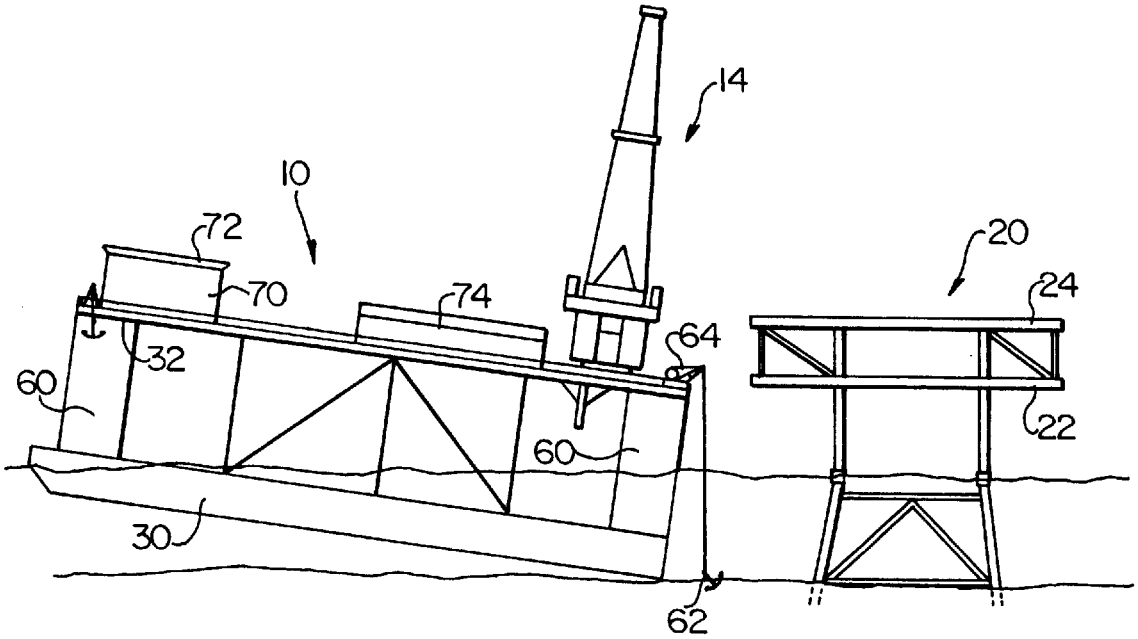
FIG. 4 is a port side elevational view of the vessel and the fixed drilling platform of FIG. 1, in which the rear of the vessel is submerged.
Figure 5:
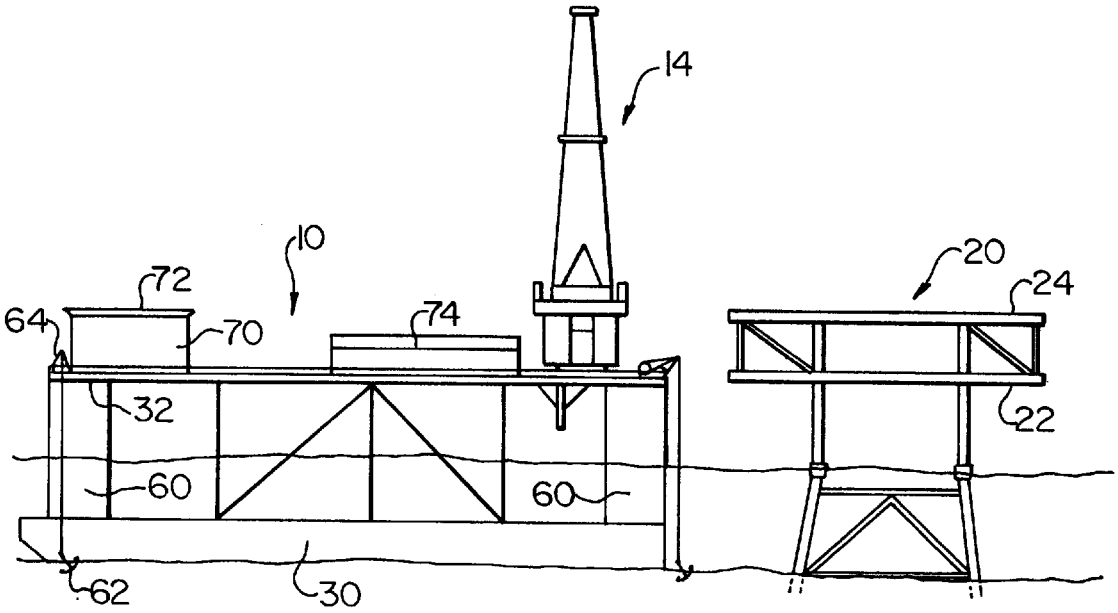
FIG. 5 is a port side elevational view of the vessel and oil drilling platform of FIG. 1, in which submersion of the vessel is complete.

In operation, the vessel 10 is towed bow first to a location at a transit water level, and then turned so that its stern faces the fixed drilling platform 20 (FIG. 1). The vessel 10 is ballasted downward by pumping ballast water into the lower hulls 30. As shown in FIGS. 4 and 5, the stern is submerged first, and then the bow. The stabilization columns 60 function to stabilize the vessel as it is being submerged, that is, once the upper surfaces of the lower hulls 30 are below the water level. The stabilization columns 60 are maintained during the ballasting down procedure. The pump room 56 is manned during ballasting operations. All ballasting operations are controlled from the pump room 56, and all skidding operations are controlled from a console on the main deck 32. The anchoring system provides the means to make final adjustments to the vessel 10 for alignment purposes by lowering the anchor 62 at each corner of the stern just as the stern touches the bottom. The anchoring system can be retained with the anchors 62 lowered through drilling or production procedures.

The water level will determine the bottom loading conditions when the ballasting operation is complete. The ocean bottom will have variable strength conditions, which will determine the level at which the vessel 10 will settle.

When the drilling operation calls for the packaged drilling rig 14 to remain in the slot 42 or for the packaged drilling rig 14 to be extended outward beyond the slot 42, only the horizontal jacking system is used to translate the packaged drilling rig 14 horizontally to the desired position, in a manner to be described hereinafter. When the drilling operation calls for the packaged drilling rig 14 to be elevated or skidded off the rig onto a fixed drilling platform 20, as shown in FIGS. 6–10, both the vertical and horizontal jacking systems are used.

Figure 6:
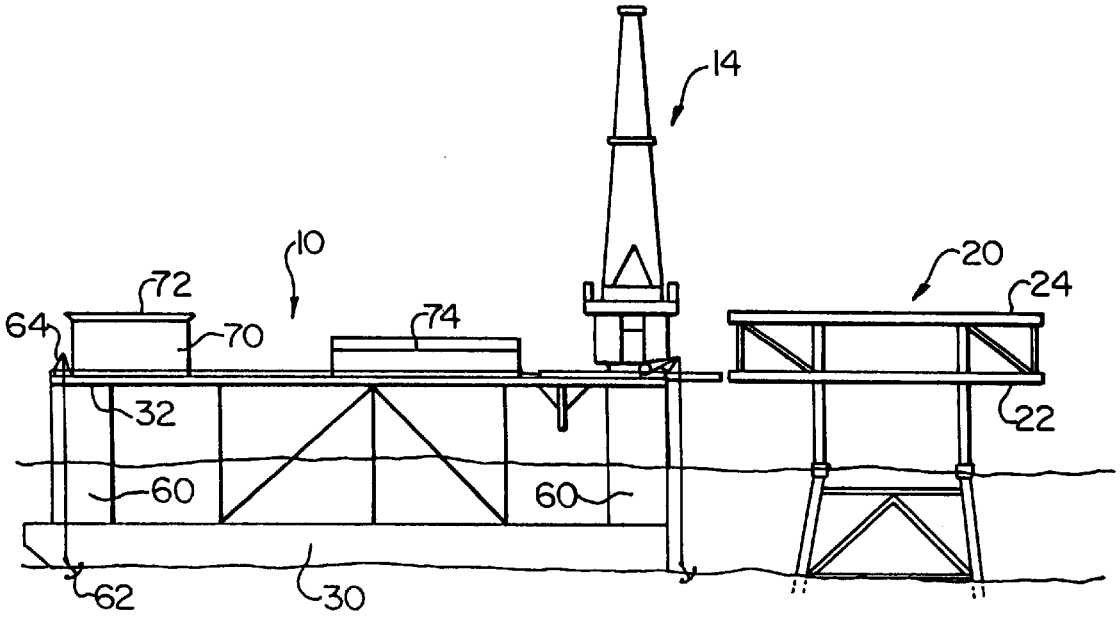
FIG. 6 is a port side elevational view of the vessel and fixed drilling platform of FIG. 1, with the vessel submerged as in FIG. 5, with the cantilever beams in their extended position.

Once the fixed drilling platform 20 has been approached and the vessel 10 submerged, the distance from the stem of the vessel 10 to the edge of the drilling platform 20 is measured. The cantilever beams 110 are then extended the measured distance using the horizontal jacking system (FIG. 6). A horizontal jack unit 114 is placed on each of the main structural beams 40 adjacent the forward end of each of the cantilever beams 110, with the pins inserted into a pair of holes in the master beam. The shoe jacks 164 are actuated to raise the cantilever beams 110 off the guide shoe platforms 154 and the pistons 182 of the horizontal jack units 114 are actuated to push the cantilever beams 110 horizontally beyond the stem of the vessel 10. It may be necessary to reposition the shoe jacks 164 adjacent the forward ends of the cantilever beams 110 a number of times in successively more rearward positions as the cantilever beams 110 are pushed rearwardly, until the cantilever beams 110 are in the desired position. At that point the horizontal jack units 1 14 are disconnected and the shoe jack are retracted, bringing the cantilever beams 110 back into contact with the platforms, effectively locking the cantilever beams 110 in place against horizontal movement.

Figure 9:
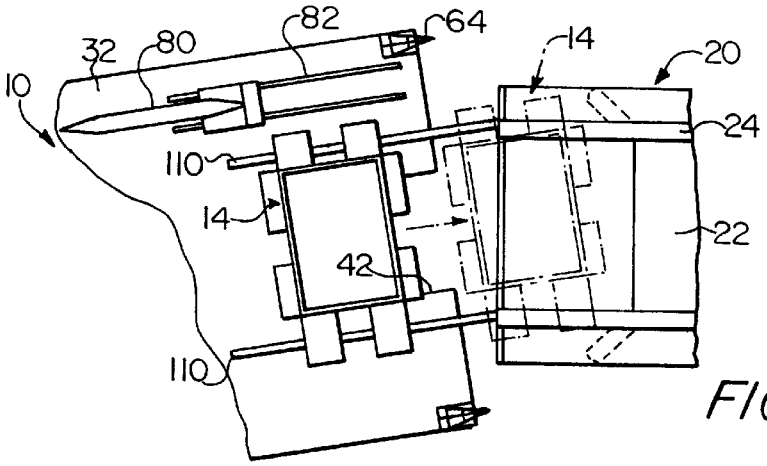
FIG. 9 is a partial top plan view of the vessel and the fixed drilling platform, in which the stern of the vessel and the edge of the fixed drilling platform are not in parallel alignment, illustrating movement of the packaged drilling rig from the cantilever beams to the packaged drilling rig.
Figure 10:
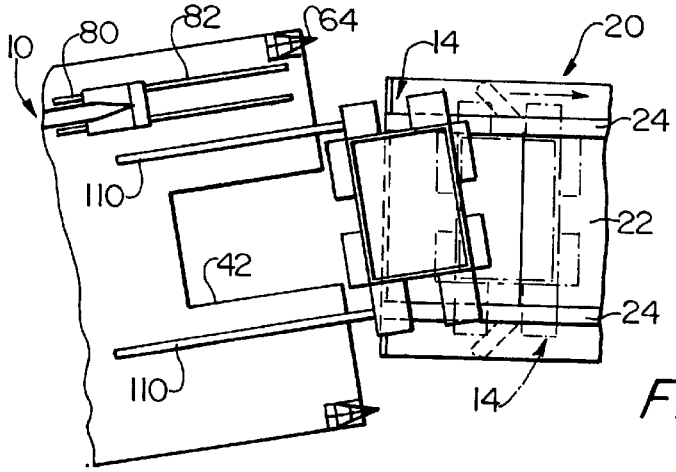
FIG. 10 is a partial top plan view of the vessel and the fixed drilling platform, similar to FIG. 9, with the packaged drilling rig partially moved on the fixed drilling rig.
Figure 11:
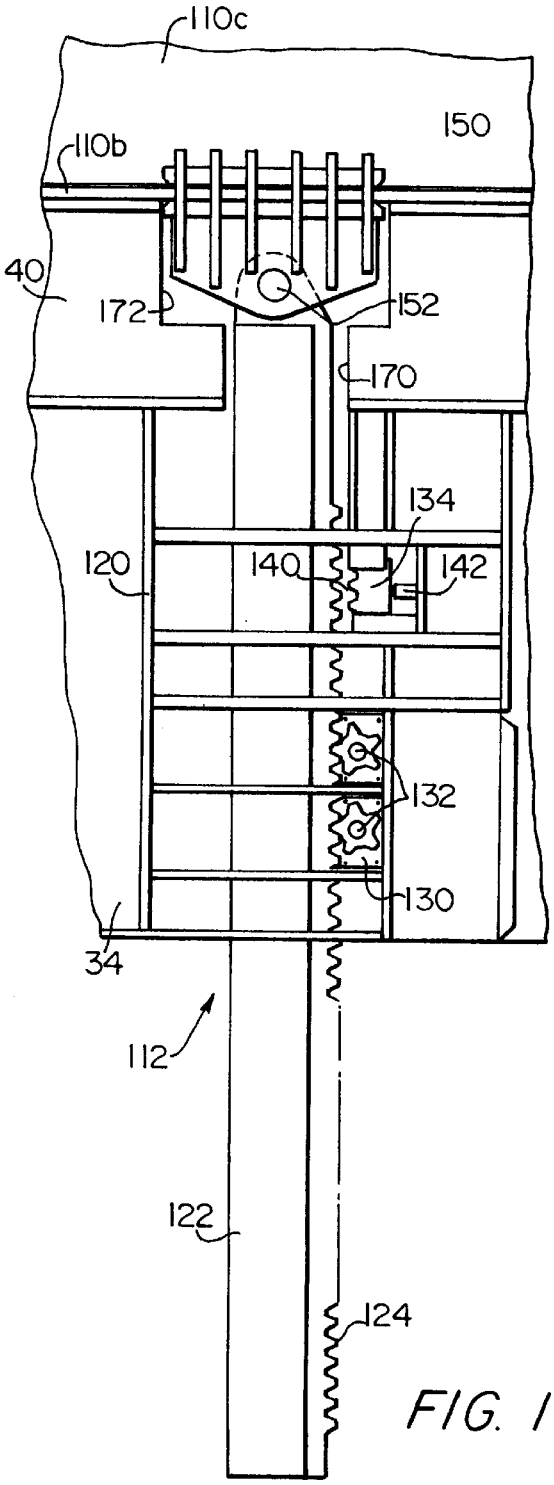
FIG. 11 is a side elevational view of a section of the vertical jacking structure in accordance with the present invention, in its retracted position.
Figure 12:
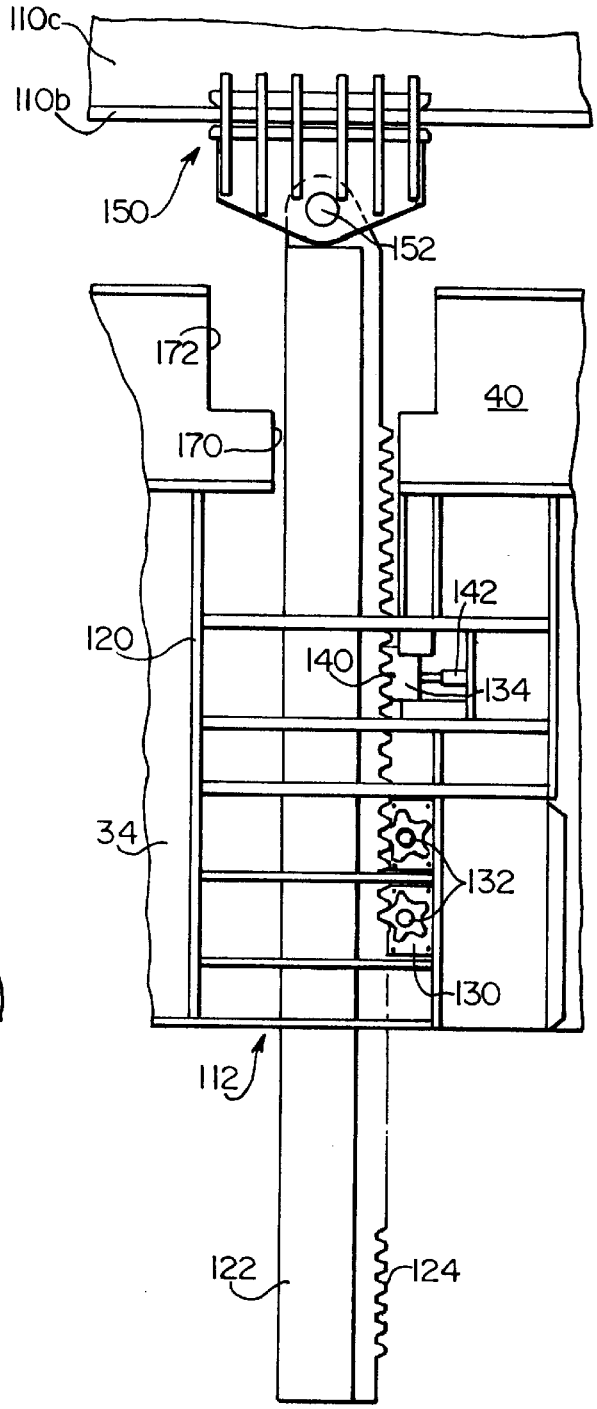
FIG. 12 is a side elevational view of the vertical jacking structure of FIG. 11, in a partially extended position.
Figure 13:
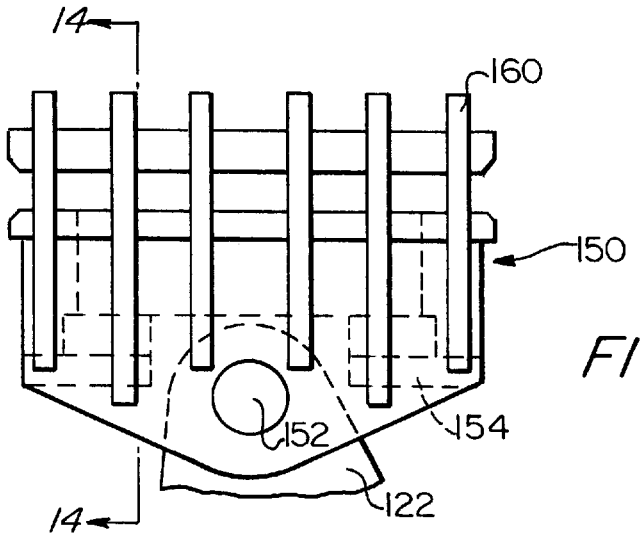
FIG. 13 is a side elevational view of a guide shoe for one of the cantilever beams in accordance with the present invention.
Figure 14:
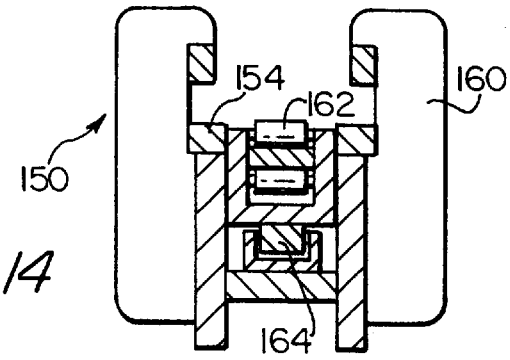
FIG. 14 is a cross-sectional view taken along line 14—14 of FIG. 13.
Figure 15:
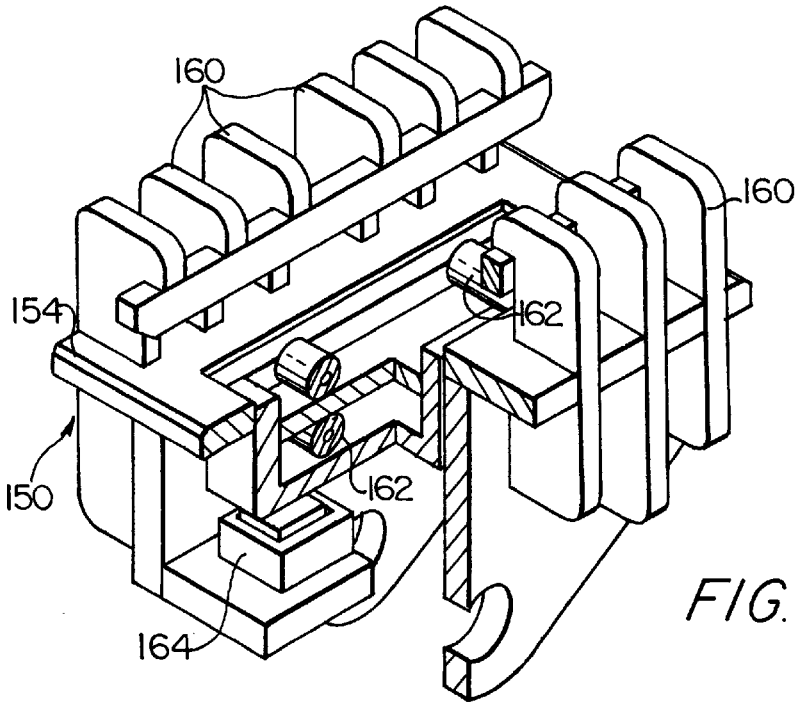
FIG. 15 is a perspective view, partially cut away, of the guide shoe of FIG. 13.

Due to the construction of the horizontal jacking system, the cantilever beams 110 can be extended individually, and by different amounts. Thus, each of the cantilever beams 110 can be extended to the edge of the drilling platform 20, even if the stem of the vessel 10 and the edge of the drilling platform 20 are not exactly parallel, as shown in FIGS. 9 and 10.

Figure 7:
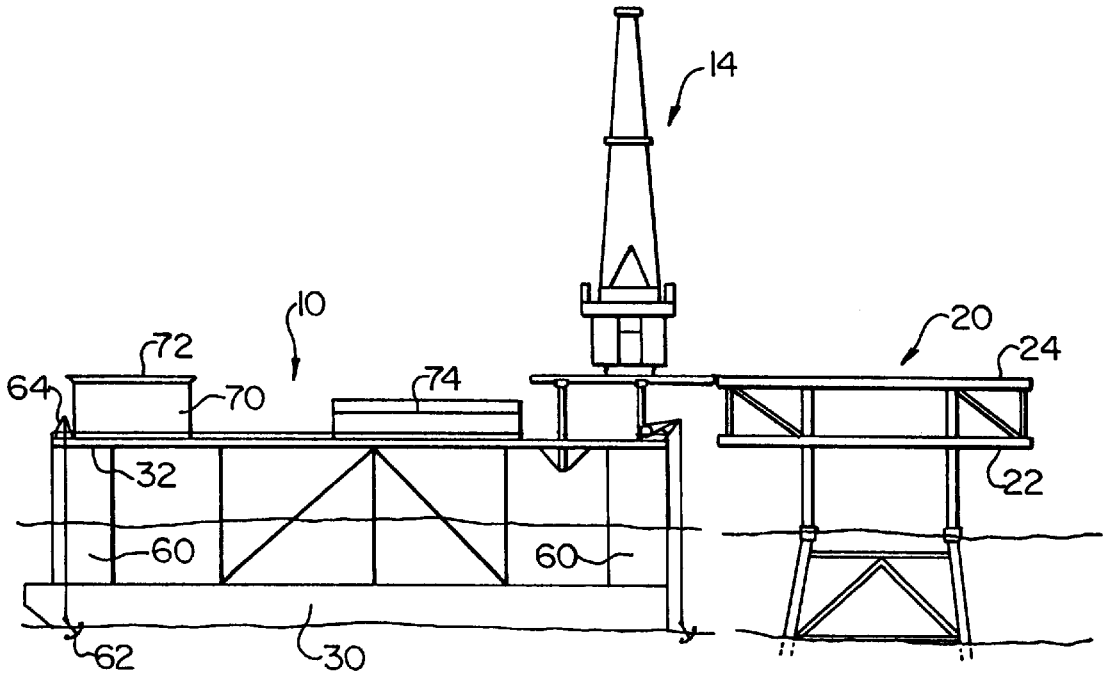
FIG. 7 is a port side elevational view of the vessel and fixed drilling platform of FIG. 1, with the cantilever beams of the vessel in their extended position and with the vertical jacking system extended.
Figure 8:
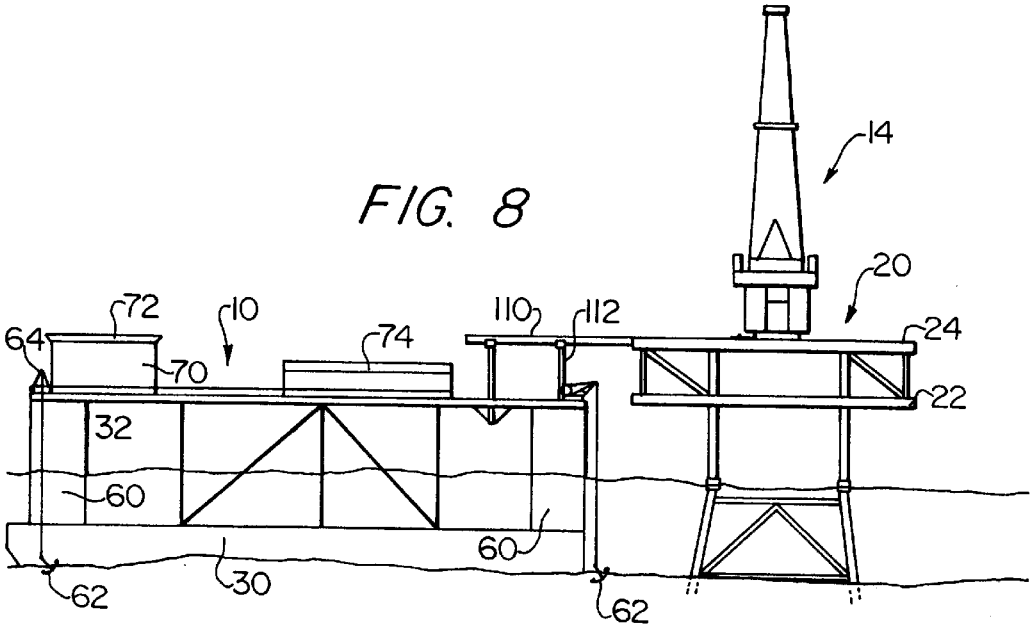
FIG. 8 is a port side elevational view of the vessel and fixed drilling platform of FIG. 1, with the packaged drilling rig skidded onto the fixed drilling platform.

The vertical jack units 112 are employed to lift the cantilever beams 110 to a desired height (usually that of the fixed drilling platform skid beams 24) by actuating the drive motors 130 (FIG. 7). This height is predetermined by the platform height, the caisson height, or the water depth. Once the vertical jack units 1 12 have lifted the cantilever beams 110 to the desired height, the jack legs 122 are individually adjusted to level the cantilever beams 110.

As will be appreciated by those of skill in the art, it is not necessary for the cantilever beams 110 to be aligned with the skid beams 24 in a collinear fashion. The cantilever beams 110 need only be aligned relative to the skid beams 24 so that the packaged drilling rig 14 can be skidded off the cantilever beams 110 onto the skid beams 24. Consequently, as shown in FIGS. 9 and 10, the stem of the vessel can be at an angle to the drilling deck 22 of the fixed drilling platform 20, and the cantilever beams 110 can be at an angle to the skid beams 24. Further, the cantilever beams 110 can be slightly offset from the skid beams 24. However, the cantilever beams 110 must be placed level with the platform 20 by the vertical jacking system to a degree of accuracy which will allow the packaged drilling rig 14 to move onto the skid beams 24 on the drilling deck 22 of the platform 20. Once the vertical jack units 112 have been fully adjusted at their desired heights, the lock 134 associated with each jack leg 122 is actuated to lock the vertical jack units 112 in place.

Final adjustment of the packaged drilling rig 14 relative to the platform 20 is accomplished while the packaged drilling rig 14 is on the cantilever beams 110. Sideways alignment of the packaged drilling rig 14 relative to the platform 20 and skidding of the packaged drilling rig 14 off of the cantilever beams 110 and onto the skid beams 24 of the fixed drilling platform 20 are accomplished in a conventional manner by conventional gripper jacks 200 positioned on each cantilever beam 110 to engage the forward spanner beam 100 beneath the packaged drilling rig 14.

Under some circumstances, even when the vessel is submerged and the jack legs 122 are fully retracted, the drilling deck 22 of the fixed platform 20 may be below the level of the cantilever beams 110. In such circumstances, as shown in FIGS. 18 and 19, a prefabricated pony structure 210 can be placed on the drilling deck 22 of the fixed platform 20 to effectively raise the level of the drilling deck 22. The pony structure 210 comprises a rectangular frame 212 which rests on the drilling deck 22 of the fixed platform 20, and includes at the top thereof a pair of spaced, horizontally-extending, parallel beams 214 which take the place of the fixed platform skid beams 24. The pony structure 210 is carried by the vessel 10, and can be loaded onto and off-loaded from the drilling deck 22 of the fixed platform 20 using the crane 80. It will be appreciated that the pony structure 210 is loaded onto the drilling deck 22 of the fixed platform 20 so that its top beams 214 are oriented in substantially the same direction as the skid beams 24. The horizontal and vertical jack units 112 can then be employed as described above to position the packaged drilling rig 14 relative to the pony structure 210.

Once the packaged drilling rig 14 has been moved to the fixed platform 20, the drilling operation can begin. The vessel's equipment and crew quarters permit the vessel 10 to function as a "mother ship" to support the drilling operation. On completion of the drilling operation, the packaged drilling rig 14 is retracted from the fixed platform 20 or other well centers by reversing the steps employed to position it on the fixed platform 20.

The crane 80 can be engaged to disassemble the packaged drilling rig 14 and off-load its components from the vessel 10 onto cargo barges. The crane 80 can then lift production equipment and place it in proper order for early production operations. The production operation can be long or short term. Once the operations are completed, the vessel 10 production equipment and packaged drilling rig 14 can be used for another assignment.

The present invention provides a number of advantages over conventional systems.

Among other things, it allows complete flexibility regarding the drilling and servicing of offshore wells, in that it provides the ability to operate from a fixed bottom-setting vessel 10 and perform services which are expected of a conventional jack-up packaged drilling rig 14 costing many times that of the vessel 10. The main deck 32 of the vessel 10 employs the minimum structure necessary to accomplish the service work. The twin lower hulls 30 and tubular main structural frame 34 can be constructed by a moderate size shipyard. The vessel 10 also permits a marked increase of variable load in comparison with many conventional jack-up rigs. The large, stable main deck 32 can supply drilling and production operations more than double that of conventional jack-up rigs costing double that of the vessel 10. Also, the vessel 10 can drill, test, complete, and produce wells from one fixed, stable, cost-efficient platform 20.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A submergible vessel for use in shallow-water oil drilling, comprising:

a pair of spaced pontoons selectively submergible and raisable in water by the admission and expulsion of water;

a main deck having port and starboard sides, a bow, a stem and a longitudinal axis;

a frame supporting said main deck over said pair of pontoons; and a jacking system including a pair of parallel cantilever beams positioned on said main deck adjacent one of said port and starboard sides, said bow, and said stem and wherein, said cantilever beams have longitudinal axes, means for selectively translating said cantilever beams in a vertical direction above said main deck, and means for selectively translating said cantilever beams in a horizontal direction along the longitudinal axes of said cantilever beams.

2. The vessel of claim 1, wherein said cantilever beams are positioned adjacent said stern, and said longitudinal axes of said cantilever beams are parallel to said longitudinal axis of said desk.

3. The vessel of claim 1, wherein said deck has an inwardly extending slot formed therein at said one of said port and starboard sides, said bow, and said stem, and wherein said cantilever beams are positioned on either side of said slot.

4. The vessel of claim 3, wherein said slot is formed at said stern.

5. The vessel of claim 1, wherein said means for selectively translating said cantilever beams in a vertical direction above said main deck comprises:

two vertical jack legs positioned one end of said cantilever beams;

a drive system drivingly associated with each of said vertical jack legs for raising and lowering said vertical jack legs.

6. The vessel of claim 5, wherein said drive system associated with each of said vertical jack legs comprises a rack mounted to each of said jack legs, at least one pinion selectively engageable with said rack, and a drive motor drivingly connected to said at least one pinion.

7. The vessel of claim 6, wherein said drive system associated with each of said vertical jack legs further comprises a lock selectively engageable with said rack.

8. The vessel of claim 5, wherein said jacking system further includes a shoe mounting each of said jack legs to said one of said cantilever beams.

9. The vessel of claim 8, wherein each of said shoes is pivotably mounted to a respective vertical jack leg.

10. The vessel of claim 8, wherein each said shoe includes a platform, at least one roller housed in said platform, and at least one shoe jack for selectively raising and lowering said at least one roller above the surface of said platform, whereby said cantilever beam can be raised off of and lowered onto said platform.

11. The vessel of claim 10, wherein said means for selectively translating said cantilever beams in a horizontal direction along the longitudinal axes of said cantilever beams comprises a cylinder and piston assembly connected to a base and including a reciprocable piston rod fastened to one end of each of said cantilever beams, and means for fixing said base relating to said frame while said piston rod is extended and retracted.

12. The vessel of claim 1, further comprising a crane mounted on said deck and a pony structure movable by said crane from said deck to a deck of a fixed drilling platform, said pony structure including a frame and a pair of spaced, horizontally-extending, parallel beams positioned on said frame.

* * * * *